US005931167A

United States Patent [19]

Coleman

[11] Patent Number: 5,931,167

[45] Date of Patent: Aug. 3, 1999

[54] MAGNIFYING ATTACHMENT FOR HAND HELD IMPLEMENT

[76] Inventor: Kenneth J. Coleman, 6215 Lou Ave., Crystal Lake, Ill. 60014

[21] Appl. No.: 09/015,693

[22] Filed: Jan. 29, 1998

[51] Int. Cl.[6] ..... A45D 29/02

[52] U.S. Cl. ..... 132/73.5; 132/73; 359/802

[58] Field of Search ..... 359/368, 379, 359/380, 803, 802; 132/73.5, 73; 30/28, 26

[56] References Cited

U.S. PATENT DOCUMENTS

| | | | |
|---|---|---|---|
| 3,680,210 | 8/1972 | Steinman | 30/28 |
| 3,744,883 | 7/1973 | Williams | 350/244 |
| 3,822,088 | 7/1974 | Steiner | 350/243 |
| 3,955,884 | 5/1976 | Del Pesco, Sr. | 350/248 |
| 4,398,800 | 8/1983 | Hayes | 350/251 |
| 4,847,994 | 7/1989 | Dunn, Jr. | 30/28 |
| 4,893,406 | 1/1990 | Larson | 30/28 |
| 4,930,871 | 6/1990 | Tannahill | 350/243 |
| 4,956,915 | 9/1990 | Anderson | 30/28 |
| 5,218,482 | 6/1993 | Cioffi | 359/802 |
| 5,263,754 | 11/1993 | Coleman | 294/99.2 |
| 5,357,677 | 10/1994 | West | 30/28 |
| 5,358,297 | 10/1994 | Coleman | 294/99.2 |
| 5,370,648 | 12/1994 | Cracraft | 606/131 |
| 5,546,658 | 8/1996 | MacLeod et al. | 30/28 |
| 5,775,340 | 7/1998 | Rains | 132/73.5 |

*Primary Examiner*—Hung Xuan Dang
*Attorney, Agent, or Firm*—Baker & McKenzie

[57] ABSTRACT

An adjustable magnifying attachment for a hand held implement is provided. The adjustable magnifying attachment includes a support base, an extension arm, a lens holder, and a magnifying lens. The support base has a hole and a slot, which is configured to receive a portion of the hand held implement and to secure the support base on the hand held implement. The extension arm has a first end section and a second end section. The first end section of the extension arm is snugly mounted in the hole in the base but may still rotate and slide in the hole in the support base. The second end section of the extension arm terminates in a clip. The lens holder retains the magnifying lens and includes a mounting bracket with a pivot rod that joins a pair of opposed bracket arms at a position spaced apart from the lens holder. The pivot rod is secured in the clip of the extension arm so that the lens holder may pivot about the pivot rod. The magnifying attachment has a wide range of adjustability even after the magnifying attachment is mounted on a hand held implement. This allows the user to position the magnifying lens near the object being worked on so that best viewing angle and distance can be attained.

27 Claims, 4 Drawing Sheets

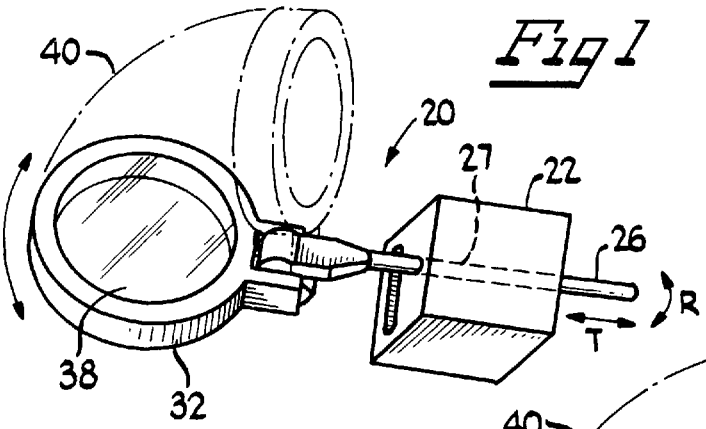
Fig 1
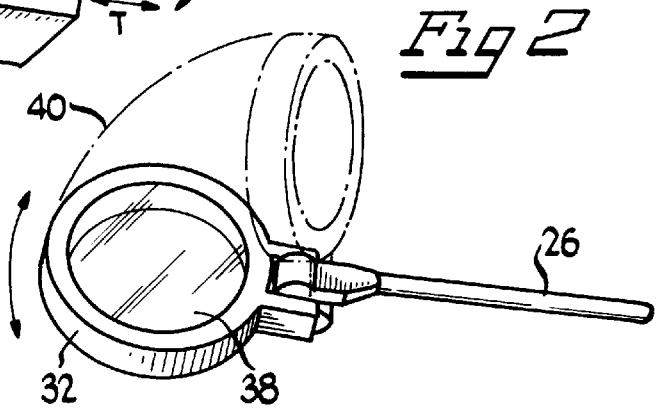
Fig 2
Fig 3A
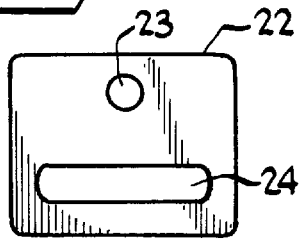
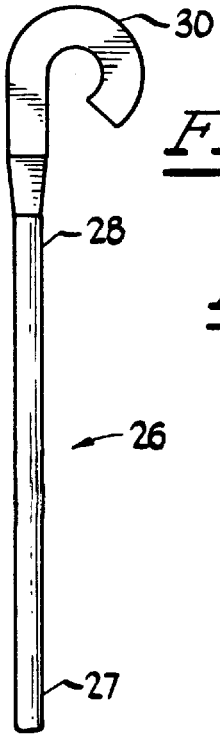
Fig 4A
Fig 3B
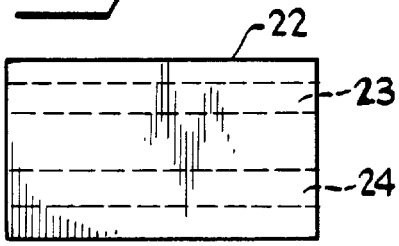
Fig 4B
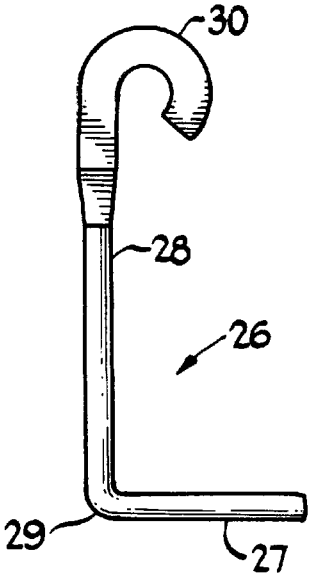
Fig 3C
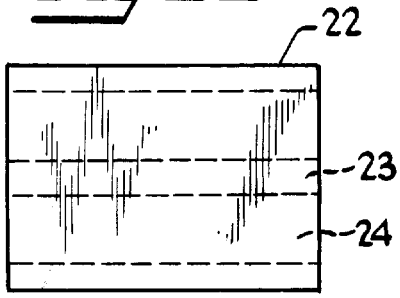

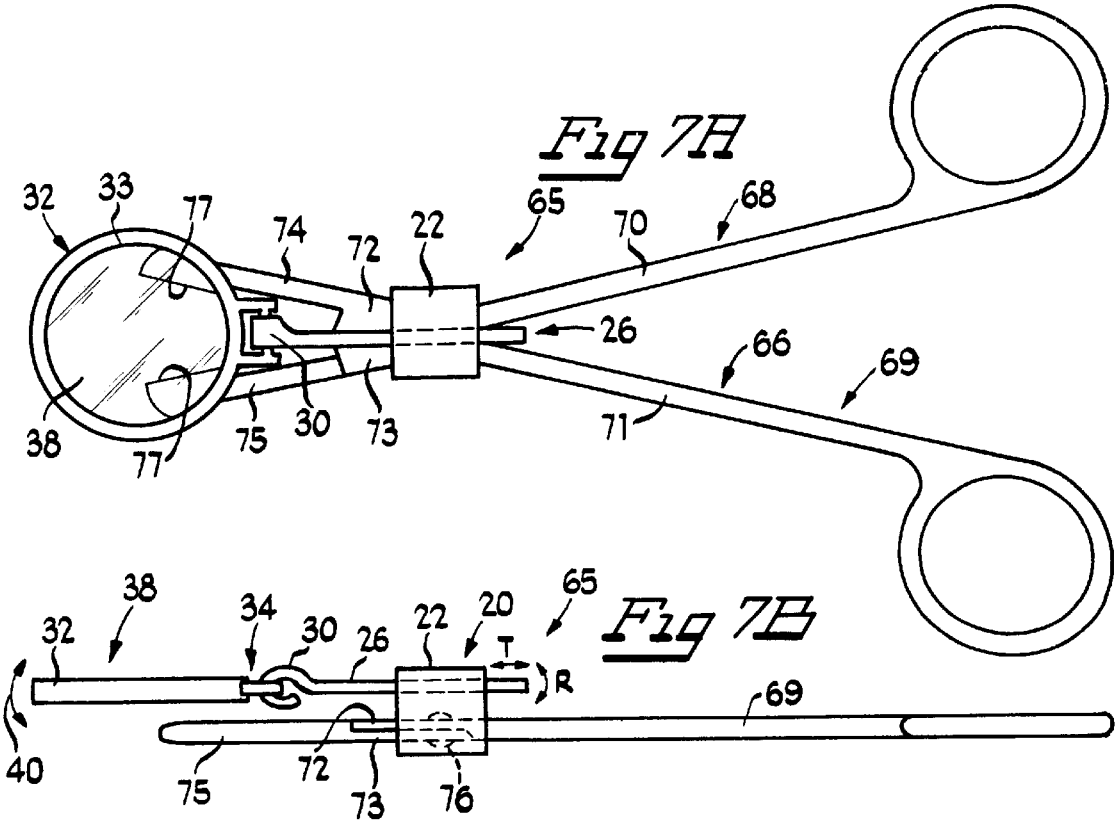
Fig 7A
Fig 7B
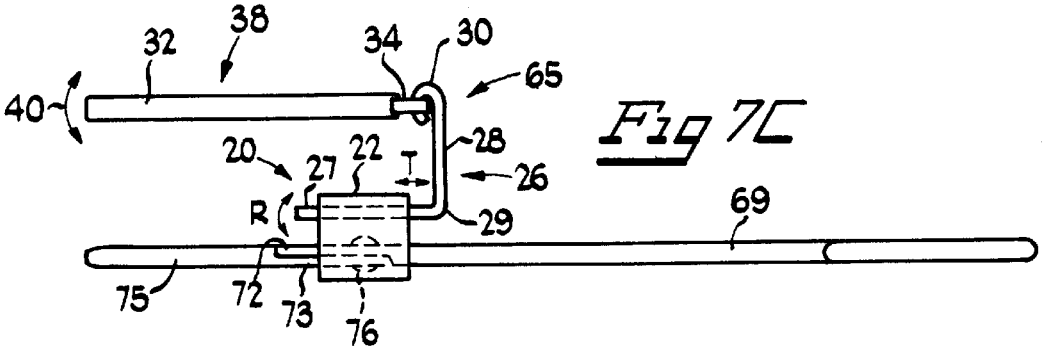
Fig 7C
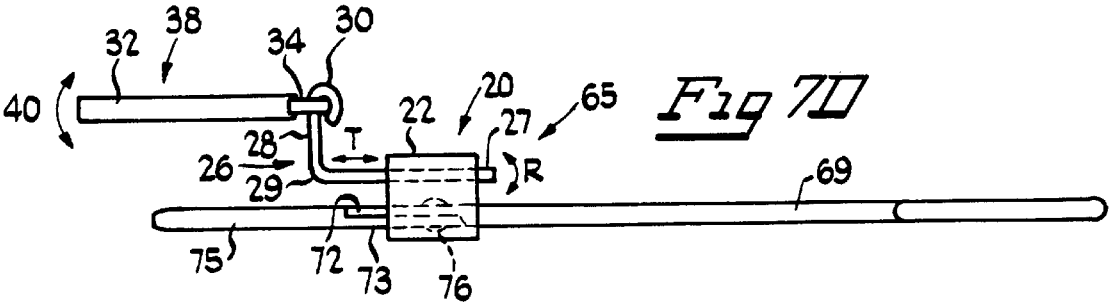
Fig 7D

MAGNIFYING ATTACHMENT FOR HAND HELD IMPLEMENT

BACKGROUND OF THE INVENTION

1. Field of the Invention

This invention relates generally to a magnifying device and more particularly to a magnifying lens attachment for a hand held implement such as nail clippers, cutters, tweezers, pliers and the like.

2. Description of the Related Art

It is known that a magnifying lens may be attached to a hand held instrument in order to provide the user with an enlarged image of the object being worked on. For example, U.S. Pat. No. 3,680,210 discloses a nail clipper device having a protective magnifying element which magnifies the blades and nail during the clipping operation; U.S. Pat. Nos. 4,956,915 and 5,546,658 disclose nail clipping devices which include an enclosure having a magnifying zone for magnifying the clipper jaws and a fingernail during the clipping operation; U.S. Pat. Nos. 5,263,754 and 5,358,297 disclose tweezers having a magnifying lens which may be positioned over the tip of the tweezers in order to assist the user in sighting the foreign object to be removed by the tweezers; and U.S. Pat. No. 4,398,800 discloses an adjustable magnifying device that may be clamped on a hand held implement.

While these devices can provide a user with enlarged images of an object being worked on, it is well known that magnifying lenses only provide optimum, clear enlarged images when an object is viewed through the magnifying lens at certain angles and distances. For instance, the spatial relationship between the user's eye, the magnifying lens, and the object being worked on can significantly affect the clarity of the object being magnified. In addition, viewing an object through a magnifying lens when the lens is at an angle to either the user's eye or the object can create blurring and distortion in the image. In order to optimize the clarity of the enlarged image, a magnifying lens must be movable to a distance and angle from the user's eye that provides the clearest image. Often, known magnifying attachments do not provide the wide range of adjustability and maneuverability that is required in order to place the magnifying lens at the optimum position for magnification. Furthermore, known magnifying attachments which do provide for adjustability are often quite cumbersome and therefore, are difficult to attach to a hand held implement.

Accordingly, there is a need for a magnifying attachment for a hand held implement that provides for a wide range of adjustability and maneuverability so that the enlarged image of the object being magnified is as clear as possible.

It is therefore an object of the present invention to provide an adjustable magnifying attachment that may be adjusted in many different directions after the attachment has been mounted on a hand held implement.

Yet another object of the present invention is to provide an adjustable magnifying attachment that may be easily mounted on a hand held implement without the need for a complicated and cumbersome mounting structure.

SUMMARY OF THE INVENTION

The present invention is directed to an adjustable magnifying attachment for a hand held implement that satisfies the need for a magnifying attachment that may be adjusted in many different directions after the attachment has been mounted on an implement. An adjustable magnifying attachment having the features of the present invention broadly comprises a support base, an extension arm, a lens holder, and a magnifying lens.

The support base of the magnifying attachment has a hole and a slot, both of which may extend from one side of the support base to another side of the support base. The slot is configured to receive a portion of the hand held implement and to secure the support base on the hand held implement.

The extension arm has a first end section and a second end section. The first end section of the extension arm is snugly mounted in the hole in the base but may still rotate and slide in the hole in the support base when a user adjusts the extension arm position. The second end section of the extension arm terminates in a C-shaped clip.

The lens holder retains the magnifying lens and includes a mounting bracket. The mounting bracket has a pair of opposed bracket arms which extend outwardly from the lens holder and a pivot rod joining the opposed bracket arms at a position spaced apart from the lens holder. The pivot rod is secured in the clip of the extension arm so that the lens holder may pivot about the pivot rod when a user adjusts the lens holder.

With this configuration of the lens holder, extension arm and support base, a wide range of adjustability is possible even after the magnifying attachment is mounted on a hand held implement. For instance, the extension arm of the magnifying attachment may be translated by a user toward or away from the support base when the extension arm is mounted in the hole of the support base. The extension arm may also be rotated by a user in any direction when the extension arm is mounted in the hole of the support base. Also, in many installations, the support base of the magnifying attachment may be moved by a user along the portion of the hand held implement on which the support base is mounted. In addition, the lens holder retaining the magnifying lens can be moved freely in an arc by a user as the pivot rod of the lens holder mounting bracket is arranged in the C-shaped clip of the extension arm. This wide range of adjustability of the magnifying attachment of the present invention allows the user to position the magnifying lens so that best viewing angle and distance can be attained.

BRIEF DESCRIPTION OF THE DRAWINGS

These and other features, aspects, objects, and advantages of the present invention will be become better understood upon consideration of the following detailed description, appended claims and accompanying drawings where:

FIG. 1 is a perspective view of an adjustable magnifying attachment for a hand held implement made in accordance with the present invention;

FIG. 2 is a perspective view Of the adjustable magnifying attachment with the support base removed from the assembly;

FIG. 3A is an end view of the support base of the adjustable magnifying attachment;

FIG. 3B is a front view of the support base of the adjustable magnifying attachment;

FIG. 3C is a top view of the support base of the adjustable magnifying attachment;

FIG. 4A is a side view of a first version of the extension arm of the adjustable magnifying attachment;

FIG. 4B is a side view of a second version of the extension arm of the adjustable magnifying attachment;

FIG. 7A is a top view of a cutters assembly including a cutters and the magnifying attachment of the present invention;

FIG. 7B is a side view of a cutters assembly including a cutters and the magnifying attachment of the present invention;

FIG. 7C is a side view of a cutters assembly including a cutters and a second version of the magnifying attachment of the present invention;

FIG. 7D is a side view of a cutters assembly including a cutters and a third version of the magnifying attachment of the present invention;

Figure 5:
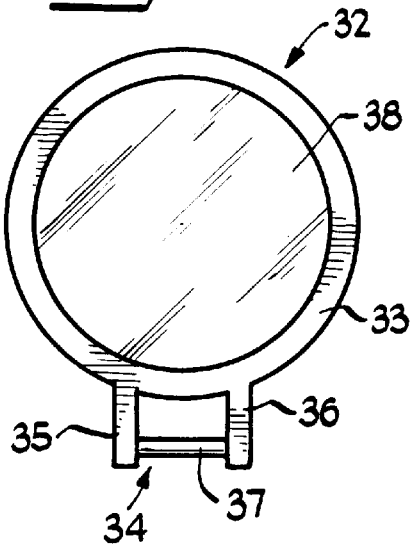
FIG. 5 is a front view of the lens holder and magnifying lens of the adjustable magnifying attachment.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

Like reference numerals will be used to refer to like or similar parts from Figure to Figure in the following description of the drawings.

DESCRIPTION OF THE PREFERRED EMBODIMENTS

Referring now to FIGS. 1-5, an adjustable magnifying lens attachment 20 in accordance with the present invention is shown. The magnifying lens attachment 20 broadly comprises a support base 22, an extension arm 26, a lens holder 32, and a magnifying lens 38.

Turning to FIGS. 3A, 3B and 3C, there is shown the support base 22 of the magnifying lens attachment 20. The support base 22 shown is configured as a rectangular prism; however, other shapes such as spheres, cubes and cylinders would also be suitable. Preferably, the support base 22 is formed from an elastic material such as an elastomer or other similar polymeric material. The support base 22 has a hole 23 which may extend part of the way into the support base 22 or may extend from one side of the support base 22 to another side of the support base 22. Though the hole 23 has a cylindrical shape in the version of the invention shown, the hole 23 may have any number of cross-sectional shapes. The support base 22 also has a slot 24 which may extend part of the way into the support base 22 or may extend from one side of the support base 22 to another side of the support base 22. The slot 24 may have any number of cross sectional shapes. In the version of the invention shown, the slot 24 has a rectangular shape.

With reference to FIG. 5, there is shown the lens holder 32 and magnifying lens 38 of the magnifying lens attachment 20. The lens holder 32 has a rim 33 in which the magnifying lens 38 is retained. The magnifying lens 38 may be made of glass or transparent rigid plastic. On the rim 33 of the lens holder 32 is a mounting bracket 34. The mounting bracket 34 includes a first bracket arm 35 and a second bracket arm 36 with a pivot rod 37 joining the bracket arms 35,36 at a position spaced apart from the rim 33. In the version of the lens holder shown, the first bracket arm 35 and the second bracket arm 36 extend outwardly from the rim 33 of the lens holder 33 in substantially parallel alignment, and the pivot rod 37 is substantially perpendicular to the opposed bracket arms 35,36.

Referring now to FIGS. 4A and 4B, various versions of the extension arm 26 of the magnifying lens attachment 20 are shown. The extension arm 26 has a first end section 27 and a second end section 28 which terminates in a C-shaped clip 30. The extension arms shown have a circular cross-section but may also be formed in other shapes. The version of the extension arm 26 shown in FIG. 4B also includes an elbow 29 which connects the first end section 27 and the second end section 28 of the extension arm 26. In the version shown in FIG. 4B, the elbow 29 is configured so that the first end section 27 of the extension arm 26 and the second end section 28 of the extension arm 26 are coplanar and form a substantially right angle.

Turning now to FIG. 2, it can be seen that the C-shaped clip 30 of the extension arm 26 is fitted over pivot rod 37 of the mounting bracket 34 of the lens holder 32. In this arrangement between the clip 30 and the pivot rod 37, the lens holder 32 with magnifying lens 38 can move freely in an arc 40 (shown in phantom in FIGS. 1 and 2). Such fittings between the clip 30 and the pivot rod 37 are usually accomplished with a snap fitting due to the flexibility of material (such as plastic) from which the extension arm 26 and clip 30 are made.

Referring now to FIG. 1, there is shown an assembled version of the adjustable magnifying lens attachment 20. The C-shaped clip 30 of the extension arm 26 is fitted over pivot rod 37 of the mounting bracket 34 of the lens holder 32, and the first end section 27 of the extension arm 26 is mounted in the hole 23 in the support base 22. The extension arm 26 and the hole 23 of the support base 22 are configured so that the first end section 27 of the extension arm 26 fits snugly in the hole 23 of the support base 22. However, the hole 23 of the support base 22 must be dimensioned such that the extension arm 26 can still move within the hole 23 of the support base 22.

With a proper construction of the hole 23 of the support base 22 and the first end section 27 of the extension arm 26, the extension arm 26 may translated by a user freely in any direction along the arrows designated at T in FIG. 1 and may be rotated by a user freely in any direction along the arrows designated at R in FIG. 1 when the extension arm 26 is mounted in the hole 23 of the support base 22. However, the extension arm 26 must fit snugly in the hole 23 of the support base 22 so that the extension arm 26 does not slip out of the hole 23. By forming the support base 22 from an elastic material as noted above, it is possible to effectively retain the extension arm 26 in the support base 22 while still allowing the extension arm 26 to move in the "T" and "R" directions.

The slot 24 of the support base 22 may be dimensioned in various configurations so that the support base 22 of the magnifying attachment 20 may be secured on any number of hand held implements. Typically, a hand held implement that would benefit from the provision of a magnifying lens is examined to determine the location where a magnifying attachment could be mounted on the implement. The portion of the hand held implement that could be surrounded by the support base 22 is then measured. When fabricating the support base 22, the slot 24 of the support base 22 is dimensioned so that the slot 24 of the support base 22 can receive the portion of the hand held implement and can snugly secure the support base 22 on the hand held implement. In this manner, the support base 22 can be held steady on the hand held implement.

The magnifying attachment 20 of the present invention is suitable for use with many different hand held implements but has proven to be particularly advantageous when used with nail clippers, cutters, tweezers, and pliers. Therefore, the use of the magnifying attachment 20 with these hand held implements is described hereinbelow in order to further illustrate uses of the invention.

Figure 6B:
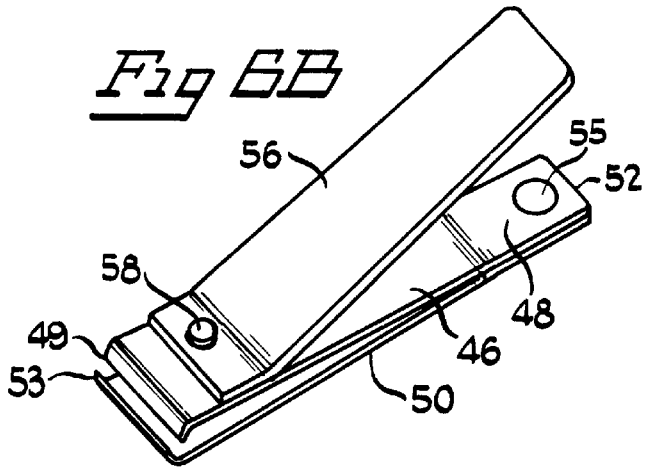
FIG. 6B is a perspective view of a nail clippers that may be used with the adjustable magnifying attachment of the present invention.
Figure 6A:
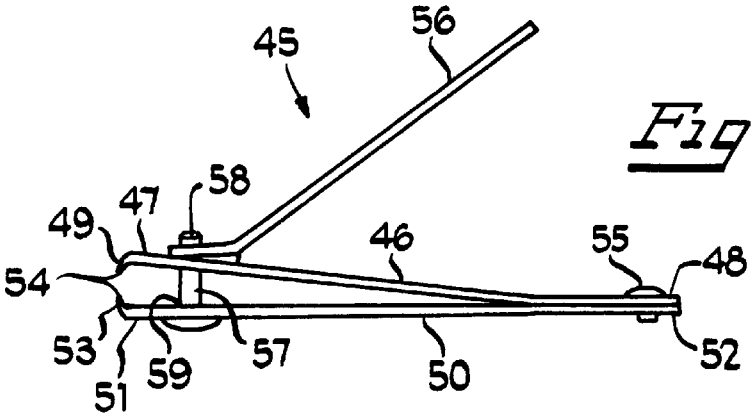
FIG. 6A is a side view of a nail clippers that may be used with the adjustable magnifying attachment of the present invention.
Figure 6C:
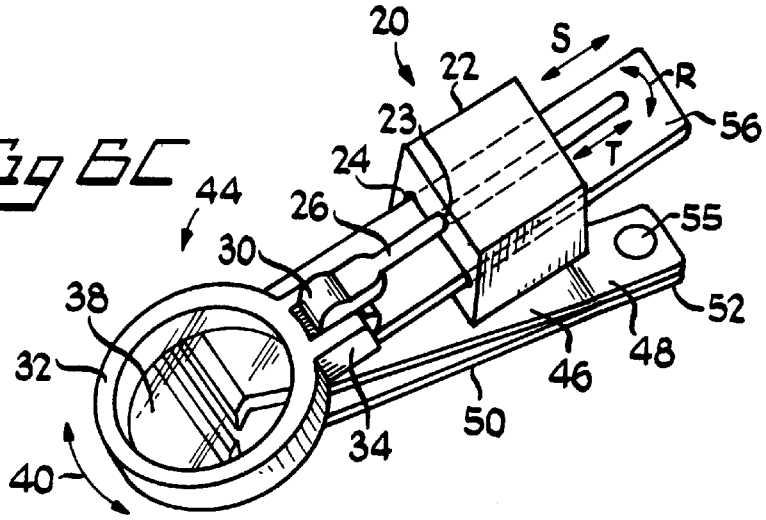
FIG. 6C is a perspective view of a nail clippers assembly including the nail clippers shown in FIGS. 6A & 6B and the magnifying- attachment of the present invention.

One hand held implement whose operation may be significantly enhanced by the magnifying attachment of the present invention is a nail clippers. Referring now to FIGS. 6A, 6B and 6C, there is shown a nail clippers 45 of the conventional type. The nail clippers 45 includes an elongated upper spring member 46 and an elongated lower spring member 50. The upper spring member 46 has a front end 47 and a rear end 48. The lower spring member 50 has a front end 51 and a rear end 52. The upper spring member 46 and the lower spring member 50 are secured together at their respective rear ends by suitable means such as riveting or welding. In the nail clippers shown, the rear end 48 of the upper spring member 46 and the rear end 52 of the lower spring member 50 are secured together by rivet 55. The front end 47 of the upper spring member 46 terminates in an upper jaw 49, and the front end 51 of the lower spring member 50 terminates in a lower jaw 53. The upper jaw 49 and the lower jaw 53 are biased slightly apart to define opposed cutting edges 54. An actuating lever 56 is operatively associated with the front ends of the upper and lower spring members for releasably forcing the cutting edges into engagement with each other and cutting a fingernail or toenail disposed therebetween. The actuating lever 56 is carried by an upper end 58 of a central pivot fastener 57 rotatably secured upwardly through a forward portion of the lower spring member 50 and rotatably received upwardly through a forward portion of the upper spring member 46. The actuating lever 56 is pivotally mounted from the upper end 58 of the central pivot fastener 57 projecting above the upper spring member 46. In operation, the actuating lever 56 is pivoted toward the upper spring member 46 in order to move the upper jaw 49 and the lower jaw 53 together.

The nail clippers structure heretofore described is conventional and well known. However, as seen from FIG. 6C, the conventional nail clippers 45 may be provided with the magnifying attachment 20 of the present invention in order to magnify and present an improved view of both the jaws of the nail clippers and the object being cut during the clipping operation. The magnifying attachment 20 may be mounted on the nail clippers 45 by inserting the actuating lever 56 of the nail clippers 45 in the slot 24 of the support base 22 of the magnifying attachment 20. As noted above, the slot 24 of the support base 22 is configured so that the actuating lever 56 fits snugly in the slot 24. This assures that the support base 22 remains fixed on the actuating lever 56 when the nail clippers 45 is operated.

It can be appreciated that the magnifying attachment 20 of the present invention provides for maximum adjustability when mounted on the nail clippers 45. As shown in FIG. 6C, the positioning of the magnifying lens 38 of the magnifying attachment 20 may be adjusted in numerous directions. First, the extension arm 26 of the magnifying attachment 20 may be translated by a user in any direction along the arrows designated at T when the extension arm 26 is mounted in hole 23 of support base 22. Second, the extension arm 26 of the magnifying attachment 20 may be rotated by a user in any direction along the arrows designated at R when the extension arm 26 is mounted in hole 23 of support base 22. Third, the support base 22 of the magnifying attachment 20 may be slid by a user in any direction along the arrows designated at S when the actuating lever 56 is inserted in slot 24 of support base 22. Fourth, the lens holder 32 with magnifying lens 38 can be moved freely by a user in an arc 40 (as shown in phantom in FIGS. 1 and 2). The wide range of adjustability of the magnifying attachment 20 of the present invention allows the user of the nail clippers assembly 44 to position the magnifying lens so that best viewing angle and distance can be attained.

Another hand held implement whose operation may be significantly enhanced by the magnifying attachment of the present invention is a cutters, such as a cuticle cutters, mini cutters, scissors or the like. Referring now to FIGS. 7A, 7B, 7C and 7D, there is shown an improved cutters assembly 65 which generally comprises a pair of standard cutters 66 and a magnifying attachment 20 in accordance with the present invention.

The cutters 66 may be of any standard construction, and the cutters 66 illustrated herein is a conventional and well-known type. The cutters 66 has a pair of opposed handle arms 68 and 69 including respective handle portions 70,71, centrally located pivot portions 72,73, and front blade portions 74,75. The handle arms 68 and 69 are pivotally secured together by a pivot pin 76 passing through the pivot portions 72 and 73.

In the type of cutters 66 illustrated herein, the blade portions 74,75 each have a cutting edge 77. It will be seen in FIG. 7A, that when the opposed handle arms 68 and 69 are moved toward each other, the blade portions 74,75 are brought together in closed or cutting position with the cutting edges 77 in abutment with each other.

The cutters structure heretofore described is well known. In accordance with the invention herein, the cutters 66 is also provided with the magnifying attachment 20 which serves to magnify and present an improved view of the cutting edges 77 and the object being cut during the cutting operation. The magnifying attachment 20 may be mounted on the cutters 66 by closing the blade portions 74,75 of the cutters 66 and inserting the closed blade portions 74,75 of the cutters 66 in the slot 24 of the support base 22 of the magnifying attachment 20. The cutters 66 is inserted into the slot 24 until the support base 22 covers a section of the cutters 66 wherein the pivot portions 72,73 of the opposed handle arms 68,69 are pivotally secured by the pivot pin 76. It can be appreciated that the support base 22 must be installed at a position beyond the blade portions 74,75 of the cutter 66 so that the blade portions 74,75 have the proper clearance to open and close when cutting an object. The slot 24 of the support base 22 is configured so that the section of the cutters 66 near the pivot pin 76 fits snugly in the slot 24. This assures that the support base 22 remains fixed on the cutters 66 when the cutters 45 is operated.

Alternate versions of the magnifying attachment 20 are also quite effective when employed with a cutters 66. It can be seen from FIG. 7C that a second configuration of the extension arm 26 provides for a first alternative configuration of the magnifying attachment 20 that is suitable for use with the cutters 66. The second version of the extension arm 26 allows the magnifying lens to be placed further above the blade portions 74,75 of the cutters 66 but more toward the pivot portions 72,73 of the cutters 66. This location of the magnifying lens may be optimum for certain cutting operations. As seen in FIG. 7D, the second configuration of the extension arm 26 can also provide for a second alternative configuration of the magnifying attachment 20 that is suitable for use with the cutters 66. This configuration allows the magnifying lens to be placed further above the blade portions 74,75 of the cutters 66 but more toward the end of the blade portions 72,73 of the cutters 66. This location of the magnifying lens may be optimum for different cutting operations.

It can be appreciated that the magnifying attachment 20 of the present invention provides for maximum adjustability when mounted on cutters 66. As shown in FIGS. 7B, 7C and 7D, the positioning of the magnifying lens 38 of the magnifying attachment 20 may be adjusted in numerous directions. First, the extension arm 26 of the magnifying attachment 20 may be translated in any direction along the arrows designated at T when the extension arm 26 is mounted in hole 23 of support base 22. Second, the extension arm 26 of the magnifying attachment 20 may be rotated in any direction along the arrows designated at R when the extension arm 26 is mounted in hole 23 of support base 22. Third, the lens holder 32 with magnifying lens 38 can move freely in arc 40 (as shown in phantom in FIGS. 1 and 2). The wide range of adjustability of the magnifying attachment 20 of the present invention allows the user of the cutters assembly 65 to position the magnifying lens so that best viewing angle and distance can be attained.

Figure 8A:
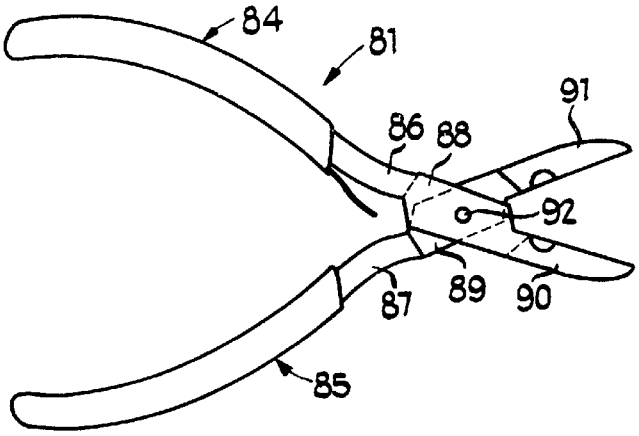
FIG. 8A is a top view of a pliers that may be used with the adjustable magnifying attachment of the present invention.
Figure 8B:
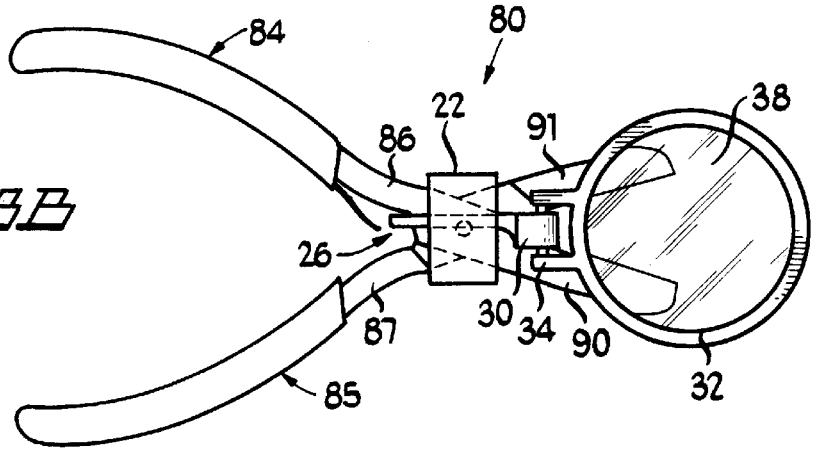
FIG. 8B is a top view of a pliers assembly including the pliers shown in FIG. 8A and the magnifying attachment of the present invention.

Still another hand held implement whose operation may be significantly enhanced by the magnifying attachment of the present invention is a pliers. Referring now to FIGS. 8A and 8B, there is shown an improved pliers assembly 80 which broadly comprises a pair of standard pliers 81 and a magnifying attachment 20 in accordance with the present invention.

The pliers 81 may be of any standard construction, and the pliers 81 illustrated herein is a well-known type. The pliers 81 has a pair of opposed handle arms 84 and 85 including respective handle portions 86 and 87, centrally located pivot portions 88,89, and front clamping portions 90,91. The opposed handle arms 84 and 85 are pivotally secured together by a pivot pin 92 passing through the pivot portions 88,89.

In the type of pliers 81 illustrated herein, it can be seen that when the opposed handle arms 84,85 are moved toward each other, the clamping portions 90,91 are brought together in closed or clamping position with the clamping portions 90,91 in abutment with each other.

In accordance with the invention herein, the conventional pliers 81 is also provided with the magnifying attachment 20 which serves to magnify and present an improved view of the blades and object being held during the clamping operation. The magnifying attachment 20 may be mounted on the pliers 81 by closing the clamping portions 90,91 of the pliers 81 and inserting the closed clamping portions 90,91 of the pliers 81 in the slot 24 of the support base 22 of the magnifying attachment 20. The pliers 81 is inserted into the slot 24 until the support base 22 covers a section of the pliers 81 wherein the pivot portions 88,89 of the opposed handle arms 84,85 are pivotally secured by the pivot pin 92. It can be appreciated that the support base 22 must be installed at a position beyond the clamping portions 90,91 of the pliers 81 so that the clamping portions 90,91 have the proper clearance to open and close when grasping an object. The slot 24 of the support base 22 is configured so that the section of the pliers 81 near the pivot pin 92 fits snugly in the slot 24. This assures that the support base 22 remains fixed on the pliers 81 when the pliers 81 is operated.

After review of FIGS. 7A, 7B, 7C, 7D, 8A and 8B, it can be appreciated that the alternate versions of the magnifying attachment 20 which are quite effective when employed with a cutters 66 would also be effective when used with a pliers 81. Specifically, the first alternative configuration of the magnifying attachment 20 shown in FIG. 7C would also be suitable for use with the pliers 81. Similarly, the second alternative configuration of the magnifying attachment 20 that is shown in FIG. 7D would also be suitable for use with the pliers 81.

It can be appreciated that the magnifying attachment 20 of the present invention provides for maximum adjustability when mounted on pliers 81. Namely, the positioning of the magnifying lens 38 may be adjusted on the pliers 81 in a similar manner as shown in FIGS. 7B, 7C and 7D, which depict the positioning of the magnifying lens 38 on cutters 66. As detailed above, the extension arm 26 of the magnifying attachment 20 may be translated or rotated, and the lens holder 32 with magnifying lens 38 can be moved in an arc in order to adjust the magnifying lens to the best viewing angle.

Figure 9A:
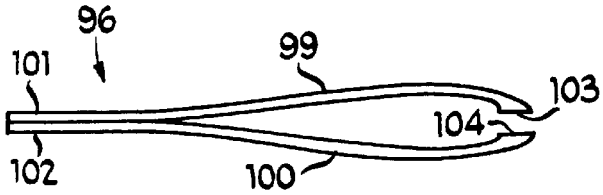
FIG. 9A is a top view of a tweezers that may be used with the adjustable magnifying attachment of the present invention.
Figure 9B:
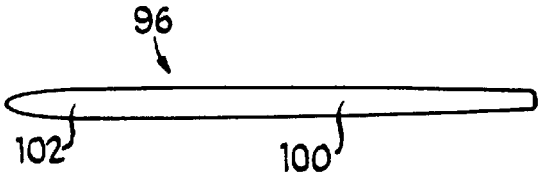
FIG. 9B is a side view of a tweezers that may be used with the adjustable magnifying attachment of the present invention.
Figure 9C:
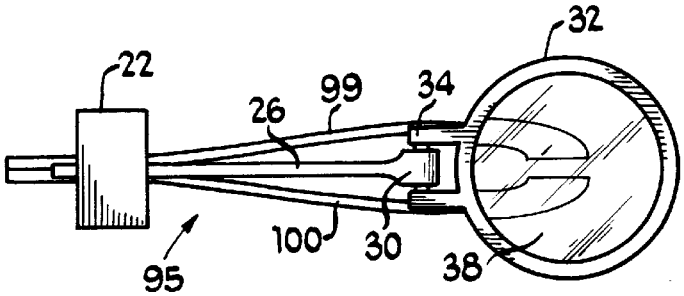
FIG. 9C is a top view of a tweezers assembly including the tweezers shown in FIGS. 9A & 9B and the magnifying attachment of the present invention.

Yet another hand held implement whose operation may be significantly enhanced by the magnifying attachment of the present invention is a tweezers. Referring now to FIGS. 9A, 9B and 9C, there is shown an improved tweezers assembly 95 which generally comprises a standard tweezers 96 and a magnifying attachment 20 in accordance with the present invention.

The tweezers may be of any standard construction such as the tweezers 96 illustrated herein. The tweezers 96 has a first elongated arm 99 and a second elongated arm 100. The first elongated arm 99 and the second elongated arm 100 include respective connection portions 101,102, and respective clamping portions 103,104. The connection portions 101, 102 of the first and second elongated arms 99 and 100 are secured together by suitable means such as welding or riveting. It can be seen from FIGS. 9A and 9B that the first and second elongated arms 99,100 extend from their connection portions 101,102 in juxtaposed, spaced, and aligned relationship. The first and second elongated arms 99,100 are formed of relatively rigid, but springlike, material so that the first and second elongated arms 99,100 are spring biased to normally maintain the clamping portions 103,104 of the first and second elongated arms 99,100 spaced apart. In operation, the user moves the first and second elongated arms 99,100 toward each other so that the clamping portions 103,104 are brought together in closed or clamping position with the clamping portions 103,104 in abutment with each other.

In accordance with the present invention, the tweezers 96 is also provided with the magnifying attachment 20 which serves to magnify and present an improved view of both the object being gripped and the clamping portions 103,104 of the first and second elongated arms 99,100. The magnifying attachment 20 may be mounted on the tweezers 96 by inserting the connection portions 101,102 of the tweezers 96 in the slot 24 of the support base 22 of the magnifying attachment 20. The slot 24 of the support base 22 is configured so that the connection portions 101,102 of the tweezers 96 fit snugly in the slot 24. This assures that the support base 22 remains fixed on the tweezers 96 when the tweezers 96 is operated.

It can be appreciated that the magnifying attachment 20 of the present invention provides for maximum adjustability when mounted on the tweezers 96. First, the extension arm 26 of the magnifying attachment 20 may be translated in the hole 23 of support base 22. Second, the extension arm 26 of the magnifying attachment 20 may be rotated in any direction when the extension arm 26 is mounted in hole 23 of support base 22. Third, the support base 22 of the magnifying attachment 20 may be slid when the connection portions 101,102 of the tweezers 96 are inserted in slot 24 of support base 22. Fourth, the lens holder 32 with magnifying lens 38 can move freely in arc. The wide range of adjustability of the magnifying attachment 20 of the present invention allows the user of the tweezers assembly 95 to position magnifying lens so that best viewing angle and distance can be attained.

Of course, further combinations of hand held implements and the magnifying attachment of the present invention are possible. In addition, it can be appreciated that the alternate versions of the magnifying attachment 20 which were shown in FIGS. 7C and 7D would be quite effective when employed with the nail clippers 45 or tweezers 96.

Thus, it is seen that an adjustable magnifying attachment for a hand held implement is provided. The adjustable magnifying attachment satisfies the need for a magnifying attachment that may be adjusted in many different directions after the attachment has been mounted on an implement. This wide range of adjustability and maneuverability allows the user to position the magnifying lens so that the enlarged image of the object being magnified is as clear as possible.

Although the present invention has been described in considerable detail with reference to certain preferred embodiments, one skilled in the art will appreciate that the present invention can be practiced by other than the preferred embodiments, which have been presented for purposes of illustration and not of limitation. Therefore, the spirit and scope of the appended claims should not be limited to the description of the preferred embodiments contained herein.

What is claimed is:

1. An adjustable magnifying attachment for a hand held implement comprising:

a support base having a hole and a slot, the slot being dimensioned to receive a portion of the hand held implement and secure the support base on the hand held implement;

an extension arm having a first end section and a second end section, the first end section being slidably and rotatably mounted in the hole in the support base, and the second end section terminating in a fastener means;

a lens holder having a mounting means, the mounting means being pivotally secured in the fastener means of the extension arm; and a magnifying lens retained in the lens holder.

2. The magnifying attachment of claim 1 wherein the fastener means comprises a clip.

3. The magnifying attachment of claim 2 wherein the mounting means comprises:

a pair of opposed bracket arms extending outwardly from the lens holder; and a pivot rod joining the opposed bracket arms at a position spaced apart from the lens holder, the pivot rod being pivotally secured in the clip of the extension arm.

4. The magnifying attachment of claim 3 wherein the hand held implement is selected from the group consisting of nail clippers, cutters, tweezers, and pliers.

5. The magnifying attachment of claim 4 wherein:

the hand held implement is a nail clippers including a pair of jaw members biased apart on ends of two attached spring members, and an actuating lever for moving the jaw members together; and the portion of the nail clippers received in the slot of the support base is the actuating lever.

6. The magnifying attachment of claim 4 wherein:

the hand held implement is a cutters including a pair of opposed handle arms, each of the opposed handle arms having a pivot portion, a blade portion attached to each pivot portion, and a pivot pin pivotally securing the pivot portions whereby the blade portions are capable of coming together when the opposed handle arms are moved toward each other; and the portion of the cutters received in the slot of the support base is a section of the cutters wherein the pivot portions of the opposed handle arms are pivotally secured by the pivot pin.

7. The magnifying attachment of claim 4 wherein:

the hand held implement is a pliers including a pair of opposed handle arms, each of the opposed handle arms having a pivot portion, a clamping portion attached to each pivot portion, and a pivot pin pivotally securing the pivot portions whereby the clamping portions are capable of coming together when the opposed handle arms are moved toward each other; and the portion of the pliers received in the slot of the support base is a section of the pliers wherein the pivot portions of the opposed handle arms are pivotally secured by the pivot pin.

8. The magnifying attachment of claim 4 wherein:

the hand held implement is a tweezers including a first elongated arm, and a second elongated arm, each of the elongated arms having a connection portion and a clamping portion, the first and second elongated arms being fixedly mounted at their respective connection portions, the first and second elongated arms extending from their connection portions in juxtaposed, spaced, and aligned relationship, and the first and second elongated arms being spring biased to normally maintain the clamping portions of the first and second elongated arms spaced apart; and the portion of the tweezers received in the slot of the support base is a section of the tweezers wherein the connection portions of the tweezers are fixedly mounted.

9. The magnifying attachment of claim 4 wherein the hole in the support base extends from one side of the support base to another side of the support base.

10. The magnifying attachment of claim 9 wherein the slot in the support base extends from one side of the support base to another side of the support base.

11. The magnifying attachment of claim 4 wherein the extension arm includes an elbow connecting the first end section and the second end section.

12. The magnifying attachment of claim 11 wherein the elbow is configured so that the first end section of the extension arm and the second end section of the extension arm are coplanar and form a substantially right angle.

13. The magnifying attachment of claim 4 wherein the opposed bracket arms are substantially parallel and the pivot rod is substantially perpendicular to the opposed bracket arms.

14. The magnifying attachment of claim 13 wherein the clip is C-shaped.

15. An adjustable magnifying attachment for a hand held implement comprising:

a support base having a hole and a slot, the slot being dimensioned to receive a portion of the hand held implement and secure the support base on the hand held implement, the hole and the slot each extending from one side of the support base to another side of the support base;

an extension arm having a first end section and a second end section, the first end section being slidably and rotatably mounted in the hole in the support base, and the second end section terminating in a C-shaped clip;

a lens holder having a mounting bracket, the mounting bracket including a pair of opposed, substantially parallel bracket arms extending outwardly from the lens holder and a pivot rod joining the opposed bracket arms at a position spaced apart from the lens holder, the pivot rod being substantially perpendicular to the opposed bracket arms, and the pivot rod being pivotally secured in the clip of the extension arm; and a magnifying lens retained in the lens holder.

16. The magnifying attachment of claim 15 wherein the hand held implement is selected from the group consisting of nail clippers, cutters, tweezers, and pliers.

17. The magnifying attachment of claim 16 wherein:

the hand held implement is a nail clippers including a pair of jaw members biased apart on ends of two attached spring members, and an actuating lever for moving the jaw members together; and the portion of the nail clippers received in the slot of the support base is the actuating lever.

18. The magnifying attachment of claim 16 wherein:

the hand held implement is a cutters including a pair of opposed handle arms, each of the opposed handle arms having a pivot portion, a blade portion attached to each pivot portion, and a pivot pin pivotally securing the pivot portions whereby the blade portions are capable of coming together when the opposed handle arms are moved toward each other; and the portion of the cutters received in the slot of the support base is a section of the cutters wherein the pivot portions of the opposed handle arms are pivotally secured by the pivot pin.

19. The magnifying attachment of claim 16 wherein:

the hand held implement is a pliers including a pair of opposed handle arms, each of the opposed handle arms having a pivot portion, a clamping portion attached to each pivot portion, and a pivot pin pivotally securing the pivot portions whereby the clamping portions are capable of coming together when the opposed handle arms are moved toward each other; and the portion of the pliers received in the slot of the support base is a section of the pliers wherein the pivot portions of the opposed handle arms are pivotally secured by the pivot pin.

20. The magnifying attachment of claim 16 wherein:

the hand held implement is a tweezers including a first elongated arm, and a second elongated arm, each of the elongated arms having a connection portion and a clamping portion, the first and second elongated arms being fixedly mounted at their respective connection portions, the first and second elongated arms extending from their connection portions in juxtaposed, spaced, and aligned relationship, and the first and second elongated arms being spring biased to normally maintain the clamping portions of the first and second elongated arms spaced apart; and the portion of the tweezers received in the slot of the support base is a section of the tweezers wherein the connection portions of the tweezers are fixedly mounted.

21. An adjustable magnifying attachment for a hand held implement comprising:

a support base having a hole and a slot, the slot being dimensioned to receive a portion of the hand held implement and secure the support base on the hand held implement, the hole and the slot each extending from one side of the support base to another side of the support base;

an extension arm having a first end section, a second end section, and an elbow connecting the first end section and the second end section, the first end section being slidably and rotatably mounted in the hole in the support base, and the second end section terminating in a C-shaped clip;

a lens holder having a mounting bracket, the mounting bracket including a pair of opposed, substantially parallel bracket arms extending outwardly from the lens holder and a pivot rod joining the opposed bracket arms at a position spaced apart from the lens holder, the pivot rod being substantially perpendicular to the opposed bracket arms, and the pivot rod being pivotally secured in the clip of the extension arm; and a magnifying lens retained in the lens holder.

22. The magnifying attachment of claim 21 wherein the hand held implement is selected from the group consisting of nail clippers, cutters, tweezers, and pliers.

23. The magnifying attachment of claim 22 wherein:

the hand held implement is a nail clippers including a pair of jaw members biased apart on ends of two attached spring members, and an actuating lever for moving the jaw members together; and the portion of the nail clippers received in the slot of the support base is the actuating lever.

24. The magnifying attachment of claim 22 wherein:

the hand held implement is a cutters including a pair of opposed handle arms, each of the opposed handle arms having a pivot portion, a blade portion attached to each pivot portion, and a pivot pin pivotally securing the pivot portions whereby the blade portions are capable of coming together when the opposed handle arms are moved toward each other; and the portion of the cutters received in the slot of the support base is a section of the cutters wherein the pivot portions of the opposed handle arms are pivotally secured by the pivot pin.

25. The magnifying attachment of claim 22 wherein:

the hand held implement is a pliers including a pair of opposed handle arms, each of the opposed handle arms having a pivot portion, a clamping portion attached to each pivot portion, and a pivot pin pivotally securing the pivot portions whereby the clamping portions are capable of coming together when the opposed handle arms are moved toward each other; and the portion of the pliers received in the slot of the support base is a section of the pliers wherein the pivot portions of the opposed handle arms are pivotally secured by the pivot pin.

26. The magnifying attachment of claim 22 wherein:

the hand held implement is a tweezers including a first elongated arm, and a second elongated arm, each of the elongated arms having a connection portion and a clamping portion, the first and second elongated arms being fixedly mounted at their respective connection portions, the first and second elongated arms extending from their connection portions in juxtaposed, spaced, and aligned relationship, and the first and second elongated arms being spring biased to normally maintain the clamping portions of the first and second elongated arms spaced apart; and the portion of the tweezers received in the slot of the support base is a section of the tweezers wherein the connection portions of the tweezers are fixedly mounted.

27. The magnifying attachment of claim 22 wherein the elbow is configured so that the first end section of the extension arm and the second end section of the extension arm are coplanar and form a substantially right angle.

* * * * *